US005580499A

United States Patent [19]

Uy

[11] Patent Number: 5,580,499

[45] Date of Patent: Dec. 3, 1996

[54] PROCESS FOR PRODUCING ZEIN FIBERS

[75] Inventor: William C. Uy, Hockessin, Del.

[73] Assignee: E. I. Du Pont de Nemours and Company, Wilmington, Del.

[21] Appl. No.: 315,809

[22] Filed: Dec. 8, 1994

[51] Int. Cl.[6] ..... D01F 1/02; D01F 4/00

[52] U.S. Cl. ..... 264/28; 264/202; 264/210.6; 264/210.8; 264/211; 264/211.14; 264/211.22; 264/211.23

[58] Field of Search ..... 264/28, 176.1, 264/178 F, 202, 210.6, 210.8, 211, 211.14, 211.15, 211.22, 211.23

[56] References Cited

U.S. PATENT DOCUMENTS

| | | | |
|---|---|---|---|
| 2,429,214 | 10/1947 | Biehn et al. | 264/202 |
| 2,475,879 | 7/1949 | Cline | 264/202 |
| 2,519,978 | 8/1950 | Press | 264/202 X |
| 2,521,704 | 9/1950 | Evans et al. | 264/202 |
| 2,521,738 | 9/1950 | McMeekin et al. | 264/178 F |
| 3,068,062 | 12/1962 | Morgan, Jr. | 264/202 |
| 3,497,369 | 2/1970 | Martin | 106/153 |

OTHER PUBLICATIONS

Croston, C. B. et al, *Industrial and Engineering Chemistry*, 37(12), 1194–1198, (1945).

*Primary Examiner*—Leo B. Tentoni

[57] ABSTRACT

The disclosed invention relates to a process wherein zein fibers are prepared by mixing zein and water, preferably btween 0° C. and 18° C., to form a free-flowing, particulate mixture; heating the mixture to a temperature of about 45° C. to about 80° C. while simultaneously extruding the mixture through a spinneret to form zein fibers which are subsequently treated with a formaldehyde stabilizing solution and drawn. This process obviates the need for environmentally unfriendly alkaline solutions and acid coagulating baths.

9 Claims, 2 Drawing Sheets

PROCESS FOR PRODUCING ZEIN FIBERS

FIELD OF THE INVENTION

This invention relates to processes for making fibers from the corn protein, zein. This invention specifically relates to improved, environmentally friendly methods for making zein fibers.

BACKGROUND OF THE INVENTION

Zein is a naturally occurring polymeric protein, obtained as a product of industrial corn processing. Compared to most proteins, zein is characterized by a relative deficiency of hydrophilic groups. In zein, the high proportion of nonpolar and acid amide side chains accounts for the solubility of zein in organic solvents and its classification as a prolamine.

Zein is essentially a globular protein in its natural state. Due to its deficiency of hydrophilic groups, zein does not dissolve easily in aqueous solutions. Hence most known processes to make zein fibers employ an alkaline solution to initially hydrate and dissolve the zein, realigning it as desired (e.g., by spinning) and finally stabilizing the new alignment by inducing cross-linking. Most often the alkaline zein solution is wet spun into acidic coagulating baths. Some processes add formaldehyde to the alkaline zein solutions. After spinning, cross-linking can be induced by treatment in coagulating baths containing formaldehyde, and stabilizing with subsequent treatment with formaldehyde. C. B. Croston et al., describe such a process in "Zein Fibers . . . Preparation by Wet Spinning", *Industrial and Engineering Chemistry*, 37 (12) (1945) 1194–1198. Croston et al. call for zein solutions for spinning containing approximately 13 to 16.5% solids, in the pH range of 11.3 to 12.7. In some experiments, denaturing or gelling agents, such as urea or alcohol were added, or denaturing was effected by applying heat. Formaldehyde was also tested as an additive to the spinning dispersions. The resulting fibers went into a coagulating bath containing sulfuric acid, acetic acid and sometimes zinc sulfate, and were then treated with a mild formaldehyde precuring bath. This precuring bath was found to be necessary prior to the final stretching of the fiber tow which was accomplished in water between two variable speed reels.

The environmental implications of such processes are a major prohibition to commercialization today. The expense of treatment and disposal of the acids, salts and organic compounds required in such processes make production of zein fibers economically impractical.

A few processes have made zein articles from mixtures comprising primarily zein and water. U.S. Pat. No. 2,521,738 discloses a process to make artificial bristles from proteins. The process comprises mixing a protein, e.g., casein or zein, with about 80 to 100 percent of its weight of water, and kneading in a mechanical mixer at 80°–100° C. until a homogeneous plastic gel is obtained. The gel is then converted into fiber bristles by extruding into air and stretching over rolls. The bristles are then treated to subsequent steps of drawing and hardening solutions, which may be a solution of formaldehyde or p-benzo-quinone. This process deliberately effects gelation, since high temperatures and pressures are used, and the bristle fibers formed have tenacities in the range of about 0.8 to about 1.2 grams/denier.

U.S. Pat. No. 3,497,369, discloses a composition of zein which is substantially dry and which upon the addition of warm water, at a temperature of about 60° C. to about 100° C. forms a pliable plastic composition which may be pulled like taffy, molded, or worked with as modeling clay. The composition consists of zein and a small portion of plasticizer such as glyceryl monoricinoleate. About 5 parts of plasticizer for every 75 parts of zein is most preferred. The composition can be molded and allowed to harden to form usable articles, such as jewelry.

SUMMARY OF THE INVENTION

This invention provides a process for producing zein fibers, comprising the steps of:

(a) mixing zein with water at a temperature of 0° C. to ambient;

(b) heating the mixture to a temperature of about 45° C. to about 80° C. to form a zein hydrate melt;

(c) forming the zein hydrate melt into zein fibers;

(d) treating said zein fibers with a stabilizing solution; and (e) optionally, drawing said fibers.

Preferred is a process for producing zein fibers, wherein in step (a) the zein is mixed with water at a temperature of about 0° C. to about 18° C. to form a free-flowing particulate mixture, and steps (b) and (c) comprise extruding the zein hydrate melt through a spinneret using an extruder having a plurality of zones, the initial zones of said extruder having an ambient temperature and the latter zones having a temperature of about 40° C. to about 50° C.

DETAILED DESCRIPTION OF INVENTION

The process of this invention provides a method for making zein fibers which avoids the alkaline solutions of zein and acidic coagulation baths of previous methods. In the process of the present invention, only water need be used to form a spinnable material, and the spun fiber becomes a solid simply through cooling in air. There are no by-products to recover or other waste products. The process of the present invention generally involves the steps of:

(a) mixing zein with water at a temperature of 0° C. to ambient;

(b) heating the mixture to a temperature of about 45° C. to about 80° C. to form a zein hydrate melt; fibers;

(d) treating said fibers with a stabilizing solution; and (e) optionally, drawing said fibers.

By the term "fibers", as used herein, is meant filaments, fibers, yarns, and threads of any denier or cross-sectional shape and bands or tows consisting of any number of such filamentary articles.

Figure 1:
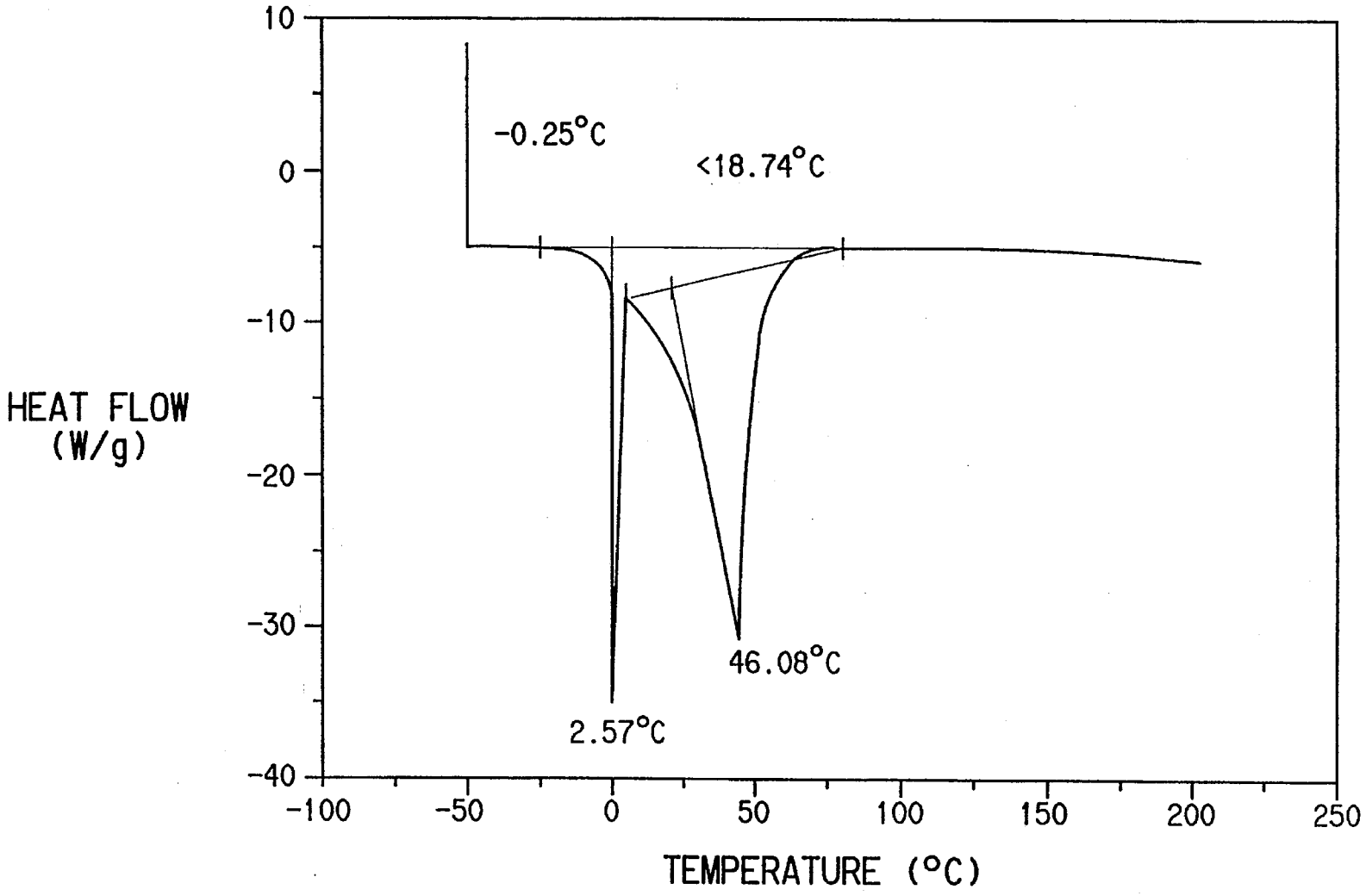
FIG. 1 shows a temperature versus heat flow curve measured on a differential scanning calorimeter (DSC) for a zein/water mixture containing about 65% by weight zein, beginning with the zein mixed with ice at –50° C., to determine the hydration temperature of zein.

This invention takes advantage of zein hydration formation with rising temperature, by forming the zein mixture into fibers while heating. As shown in FIG. 1, a plot of heat flow versus temperature for a zein/water mixture, hydration begins to occur at approximately 18° C. Therefore, when zein is mixed with water above 18° C., generally at ambient temperature (20° C. to 32° C.) or room temperature (20° C.

to 25° C.), the zein hydrates. Zein can be mixed with water at higher temperatures, for example between 32° C. and 45° C. However, since the zein particles begin to agglomerate and become a sticky, soft, dough-like material at those temperatures (see Table I), it can be difficult to handle or convey the zein hydrate as a feed stock to mechanical means used in fiber formation. Applicant has found that mixing zein and water is easier below ambient temperature.

The present invention demonstrates that preparing a zein/water mixture at a preferred temperature of about 0° C. to about 18° C. prevents the zein particles from sticking together and allows the mixture to be more easily conveyed or processed. Zein/water mixtures are free-flowing mixtures of solid particles at temperatures between about 0° C. and about 18° C. provided the zein and water have not previously formed a hydrate. The use of this lower temperature during preparation facilitates dispersion of the zein in water, which has been problematic in the past where strongly alkaline solutions were required.

One way of forming the zein/water mixture having a temperature between 0° C. and about 18° C. is by simply spraying ice water onto zein and mixing the two components together. Mixing can be performed by simply kneading by hand or with a stirring rod or by using a conventional mixing apparatus. Placing the mixture in a container and immersing the container in ice water keeps the mixture cold if storage is necessary prior to processing.

By using only water in the mixture with zein, higher zein concentrations can be used. Generally, zein concentrations greater than 50% by weight can be employed in the present invention, and can even range as high as 70%. Preferably, zein hydrate of the present invention will comprise approximately 65% zein by weight. This is at least a three time higher concentration of zein than the normal 15 to 20% used in previous methods of preparing zein fibers. An advantage to using high concentrations of zein for fiber production is that spinning into air or other gases, becomes possible, in addition to spinning into a liquid. Spinning into a gas can avoid the need for harsh chemical coagulating baths of previous methods. Previous methods using the lower concentrated solutions of zein required spinning into a liquid for the fiber to remain intact.

After mixing, the temperature of the mixture is raised, if necessary, until hydration occurs which is at about 18° C. One way of heating the mixture is by placing the mixture within a container and immersing the container in a hot water bath having a temperature between about 45° C. and about 80° C. Another way to heat the mixture is by feeding the zein/water mixture into an extruder having means for heating, such as with electrically controlled zones. As the globular, amorphous zein hydrate structure is formed and then melts, it can be formed into fibers by various mechanical means, typically using melt-spinning methods. Generally, melt spinning is preferable over wet spinning and dry spinning in the industry, in that not only is it a simpler process not requiring coagulation baths or solvent evaporation, but it operates at higher speeds with the resultant fiber displaying more uniform properties throughout.

As the temperature increases, a problem that must be overcome when handling zein hydrate is that of gelation. Zein hydrate will gel with time to give a solid mass that is not readily processable to melt-spinnable fibers thus making it impractical for most commercial fiber purposes. The rate of gelation varies with the temperature of the zein hydrate. At temperatures of about 80° C. or more, zein hydrate will quickly denature and lose its melting and fine fiber drawing properties. For example, 65% by weight zein will denature at 80° C. in less than about 15 minutes. (See Example 7). Thus the process of heating and forming fibers must be done in a timely and temperature-conscious manner in order to maintain hydrate stability and avoid gelation. Hydrated zein of the present invention is stable for up to about a week at room temperature or for a few months at about 0° C.

Figure 2:
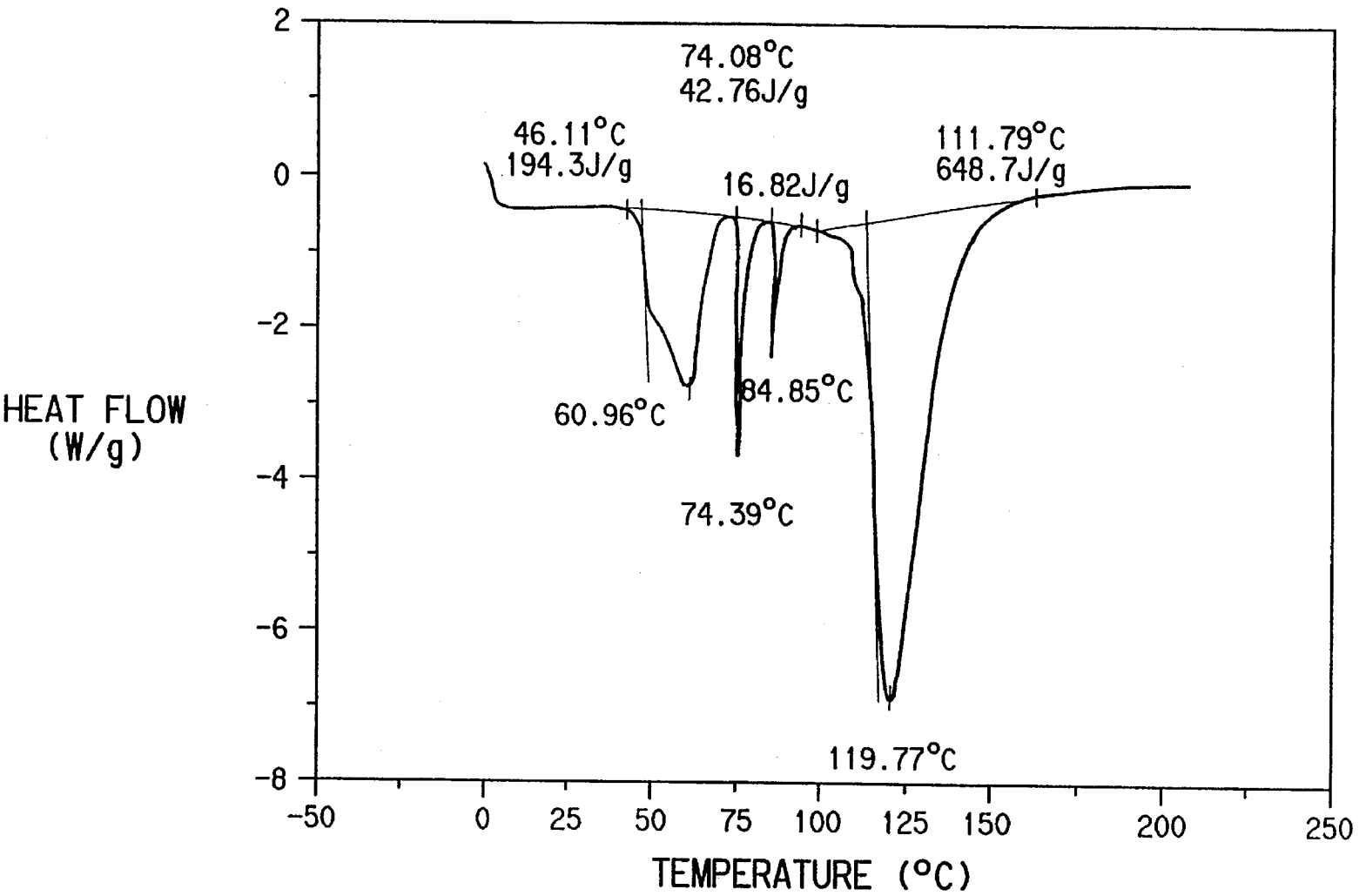
FIG. 2 shows a temperature versus heat flow curve measured on a differential scanning calorimeter (DSC) for a zein/water mixture containing about 65% by weight zein, beginning at 0 ° C. to determine the melting point of zein hydrate.

The preferred temperature of the zein hydrate for fiber formation ranges from about 45° C. to about 80° C., more preferably from about 55° C. to about 63° C. As shown in FIG. 2, at a temperature of about 46°C., zein hydrate begins to soften and melt. This zein hydrate melt is highly drawable into fibers and is at a desirable viscosity for spinning. (See Example 1 and Table I.) At temperatures above about 80° C., the zein hydrate melt rapidly loses it stickiness and ductility, making it difficult to draw, and as the temperature increases further, the zein hydrate becomes brittle.

In a preferred embodiment, fiber formation is accomplished by feeding zein and water to an extruder and subsequently to any of the standard spinnerets commonly used in the industry. Spinnerets containing one or a plurality of orifices can be used as the number of orifices in the spinneret has little effect except on the rate of fiber production. As discussed above, it is preferable that zein is mixed with ice water to form a mixture having a temperature between 0° C. and 18° C., so the zein particles do not stick together. This free-flowing particulate mixture can than be easily fed into the extruder. Alternatively, the zein and water can be added separately to the extruder by metering both ingredients into the feed hopper and mixing them together. Separate addition of ingredients to the extruder can provide better mixing and gain time against gelation as compared to premixing. It is preferable that the extruder is of the twin screw type and has a plurality of zones, each zone having its own temperature control. Since at too high temperatures, the tendency of extruders and spinnerets to become fouled and plugged is increased, preferably the initial zones, i.e., those zones nearest the feed hopper, are not heated or are at ambient temperature thus further delaying formation of the hydrate until the mixture reaches the latter zones closer to the spinneret. As the mixture is conveyed along the screws, it is gradually heated to a temperature of about 45° C. to about 80° C. The latter zones which are close to the spinneret should be maintained at temperatures which are sufficient to promote hydration and subsequently cause the zein hydrate to melt but not so high that gelation occurs rapidly. Preferably, the temperature of the heated zones is set about 40° C. to 50° C. As the mixture is conveyed through the extruder, the mixture attains a higher temperature than that set for the heated zones because of the heat generated through shear. Generally, each zone within the extruder is electrically heated and water jacketed cooled if needed. Additionally, at least the heated zones of the screw extruder should provide sufficient mixing of the zein hydrate in the molten state prior to spinning.

After reaching the appropriate temperature, the zein hydrate melt flows through a transfer line to a spin pump, which meters the melt through a spinneret and extruded as filaments, which are then quenched in the air and may pass through a water bath and onto a winder.

Optionally, plasticizer is added to the water before preparing the zein/water mixture in order to improve flow and, therefore, processability, and to reduce the brittleness of the mixture. Generally about 10 to 15% plasticizer by weight is suitable; about 10% by weight is preferable. Typical plasticizers comprise propylene glycol, and polyethylene glycol having a molecular weight below about 600. Screw type extruders for use with zein/water mixtures with or without plasticizer are commercially available.

The process of forming the zein hydrate and extruding its melt through a spinneret to form fibers effectively orients the zein molecules. Once oriented, the fiber is then stabilized by covalent cross-linking. Cross-linking is accomplished by treating the fibers with a stabilizing solution. By "stabilizing solution"it is meant an aqueous solution comprising cross-linking agents. By "cross-linking agent"is meant any material to which a mixture comprising zein is added that will cause the zein to become cross-linked. By "cross-linked zein"is meant a physical state of zein which will not melt when exposed to hot water. Suitable stabilizing solutions comprise cross-linking agents, such as formaldehyde, as well as optional anti-sticking agents, such as various salts, i.e., sodium sulfate and sodium chloride. The formaldehyde content of the stabilizing solution can be as low as 1% by weight or as high as 5%, preferably, it is 3%. The sodium sulfate can range as high as 20% by weight. The formaldehyde which is employed in the stabilizing solution of the present invention can be added to the stabilizing solution as such or it can be added in the form of materials which yield formaldehyde or react like formaldehyde under the conditions obtained in such stabilizing solutions. For instance, instead of formaldehyde itself, paraformal-dehyde, trioxymethylene, dimethylthiourea, trimethylolnitromethane and the like can be used. The fiber is immersed in the stabilizing solution for a time period sufficient to effect stabilization. Generally, this will be at least about 2 hours, though the stabilization time period will also depend on the concentration of crosslinking agent in the stabilizing solution. Temperature can also be a factor. If the fiber has already been collected on a bobbin, the bobbin can be taken off line and rewound passing it through the dilute aqueous formaldehyde solution. Alternatively, formaldehyde can be included in the water used to form the zein hydrate.

Optionally, the fibers can be drawn prior to, during, and/or after treatment in the stabilizing solution to maximize the tensile properties. By drawing, it is meant any stretching of continuous filament yarn or tow to align and further orient the molecules in order to achieve improved tensile properties.

Preferably, there is at least one drawing step after fiber formation, for example by spinning, to achieve the best tensile properties and/or to reduce denier. If the drawing step is accomplished prior to fiber stabilization, drawing should be done in water at ambient temperature, since higher temperatures can melt the fibers. Although the fibers would draw or lengthen at temperatures at or above the melting temperature, they would not achieve molecular orientation. Drawing can also be accomplished after treatment in the stabilizing solution, generally at a draw ratio greater than about 2. Higher temperatures, up to about the boiling point of water, can be used in the water for drawing after the stabilization step since the fibers will not melt at this point. By draw ratio is meant the amount by which the filaments are stretched following spinning. Generally, the draw ratio is set by controlling the ratio of speeds between the feed roll and the take-up roll of the drawing system. Continuous filaments from a bobbin are wrapped around the feed roll, may pass over a hot pin or other heating device or hot bath, and are wrapped around the take-up roll, which turns faster than the feed roll. The ratio of the takeup roll to the feed roll is the amount of draw or stretching on the filament. Multiple-stage drawing systems are contemplated as a way to further increase tensile properties.

The fibers prepared by the process of this invention are useful in the manufacture of textile materials, for example, in fabrics used for clothing and industrial end usages.

EXAMPLES

Example 1

Effect of Temperature on Zein/Water Mixtures

A few grams of zein particles (Freeman Industries, Tuckahoe, NY) were dispersed in a small jar containing excess distilled water. The jar was then placed in a hot water bath and the temperature was raised or lowered according to Table I. The temperature of the jar's content was measured using a thermocouple. The physical characteristics of the zein were observed to change with temperature as follows:

TABLE I

CHANGES IN ZEIN/WATER MIXTURE WITH TEMPERATURE

| | |
|---|---|
| 24° C. | Zein particles dispersed easily |
| 32° C. | Zein particles began to agglomerate |
| 36° C. | Particles completely agglomerated into a dough-like mass |
| 42° C. | The dough became softer |
| 50° C. | Using tweezers, the zein dough became directly drawable into fine filaments and exhibited sheer opalescence |
| 55–63° C. | The zein dough melted to a sticky and highly drawable melt |
| 83° C. | Dough lost stickiness and ductility |
| 88° C. | Dough came brittle mass |
| 61° C. | No change; dough did not regain its melting ability |

Example 2

Preperation of Zein Fibers

Hydrated zein was prepared as follows. A few grams of zein were placed inside a vial containing excess distilled water at room temperature. The vial was placed in a 60° C. water bath. A glass rod was used to stir and knead the hydrated zein dough. Further kneading was done by hand. Zein fibers were hand formed by pulling from the kneaded zein hydrate between two tweezers into a 52° C. water bath or heated in 60° C. water and quickly drawn in air. The filaments were then treated by immersion in a water bath containing: 3% formaldehyde, 20% sodium sulfate, 4% zinc sulfate, 4% glucose, 2% sulfuric acid and 0.05% cetyl pyridinum bromide. After 20 hours, the filaments were drawn in 88° C. to 95° C. water. The filaments after treatment with formaldehyde maintained their integrity and were drawn at ratios of 2 to 3×. The drawn filaments were taped to cardboard to prevent shrinkage and then air dried. Fiber tensile (denier per filament (DPF), tenacity, elongation, and modulus properties are shown in Table II.

TABLE II

TENSILE PROPERTIES OF ZEIN FIBER

| Fiber Tensile (denier/filament) | Tenacity (grams/denier) | Elongation | Modulus (grams/denier) |
|---|---|---|---|
| 159 d | 0.31 gpd | 47%–83% | 14 gpd for 90° C. 2x draw |
| 113 d | 0.32 gpd | 42% | 17 gpd for 90° C. 3x draw |
| 32 d | 0.35 gpd | 35%–102% | 15–25 gpd for 195° C. 3x draw |

Example 3

Effect of Formaldhyde Post-Treatment

Hydrated zein was similarly prepared as in Example 2. Zein fibers were formed as in Example 2 in 55°–60° C. water and immersed in a water bath containing formaldehyde and other components as described in Example 2, for 15 days. Another set of fibers was immersed in a similar bath without the formaldehyde for 15 days. The sample treated without the formaldehyde was weak and fell apart with the slightest tension in cold or hot water. The formaldehyde treated sample was more elastic than those of Example 2, which were treated for lesser time. Maximum draw was 5×in 56° C. water. Fiber properties are shown in Table III.

TABLE III

EFFECT OF FORMALDEHYDE TREATMENT ON TENSILE PROPERTIES

| | Tenacity (grams/denier) | Elongation | Modulus (grams/denier) |
|---|---|---|---|
| Unstretched | 0.31 gpd | 19% | 18 gpd |
| 2x draw at 56° C. | 0.76 gpd | 28% | 29 gpd |
| 3x draw at 56° C. | 0.62 gpd | 9% | 20 gpd |

Example 4

Melting Behavior of Zein Hydrate

This experiment was conducted to determine the melting behavior of zein hydrate. 5.0 grams of zein and 5.0 grams of distilled water were blended and then kneaded at 40°–44° C. into dough-like consistency. Thermal analysis was carried out using a Differential Scanning Calorimeter (T. A. Instruments, DSC Model 2910, New Castle, Del.) and showed a melting range of about of 46° C. to about 75° C. See FIG. 2.

Example 5

Drawing Zien Fibers

Hydrated zein was similarly prepared as in Example 2 except at a temperature of 40° C. Formed fibers, over 12 inches long, were started in 55° C. water and completed outside of the water bath. The filaments were first taped down on their ends on plastic films to avoid shrinkage and treated for 24 hours in an aqueous solution containing only 3% formaldehyde while another set of filaments were treated in an aqueous solution containing 3% formaldehyde and 7.6% sodium chloride. The treated filaments were then drawn in 80° C. water. The sample treated in the sodium chloride/formaldehyde bath was drawn only about 2–3×and had Tenacity/Elongation/Modulus=0.25 gpd/71%/9 gpd. The sample treated in the formaldehyde bath without sodium chloride was drawn 5×at 56° C. to 88° C. to study the effect of drawing temperature. Measured fiber properties indicate that drawing temperature in the range studied has little effect on tensile properties (0.44 gpd/28%/20 gpd versus 0.36 gpd/77%/20 gpd for undrawn, for tenacity, elongation, modulus, respectively) other than reducing filament denier. Best sample properties were Tenacity=1.01 gpd, Elongation=25% and Modulus=48 gpd.

Example 6

Effect of Formaldehyde Treatment Time

The effect of formaldehyde treatment time is shown by this example. Zein fibers prepared in Example 5 were treated in an aqueous solvent containing 3% formaldehyde from 1 hour to 18 hours and then drawn in 84° C. water. The results are:

TABLE IV

EFFECT OF FORMALDEHYDE TREATMENT TIME

| TREATMENT TIME (HRS) 0 (Control) | IN 84° C. WATER Melted |
|---|---|
| 1.0 | Intact, but weak |
| 2.0 | Intact; drawn 15x |
| 4.0 | Intact; drawn 18x |
| 8.0 | Intact; drawn 7x |
| 18.0 | Intact; drawn 4–5x |

Example 7

Temperature/Denaturation of Zein Hydrate Relationship

This example shows the effect of time and temperature on the denaturation of zein hydrate and its loss of fiber drawing properties. Zein hydrate was prepared as in Example 5, then placed in a constant temperature bath and monitored as to its fiber forming capability. The results are shown in Table V.

TABLE V

TIME TO DENATURE

| Temperature °C. | Time to Denature |
|---|---|
| 60 | <40 minutes |
| 70 | <17 minutes |
| 80 | <15 minutes |

Example 8

Spinning - Twin Screw Melt Extruder

A zein hydrate polymer feed, with a composition of 55% zein, 36% water and 9.0% propylene glycol was prepared in batches with each batch prepared as follows: 200g of zein was weighed into a stainless steel bowl.

While being mixed at the slowest speed setting in a "Sunbeam"mixer, 164 g of cold 20% propylene glycol solution, prepared using ice water, were sprayed into the zein. The components were mixed for another 5 minutes and then stored in a polyethylene container, immersed in ice water. Keeping the mixture cold prevented the particles from sticking together. The zein hydrate polymer feed was manually fed into the feed hopper of a twin screw extruder (Model ZSK-30 available from Werner-Pfleiderer Corp., 663 East Crescent Ave., Ramsey, N.J.) maintained at a constant temperature of 45° C. except for the first two zones, which were not heated. Spinning was accomplished using a 34 holes/25 mil spinneret with a length to diameter ratio of 4. Bobbins of multi-filament yarn were collected at 16 m/min.

What is claimed is:

1. A process for producing zein fibers, comprising the steps of:

(a) mixing zein with water at a temperature of 0° C. to ambient;

(b) heating the mixture to a temperature of about 45° C. to about 80° C. to form a zein hydrate melt;

(c) forming the zein hydrate melt into zein fibers;

(d) treating said fibers with a stabilizing solution; and (e) optionally, drawing said fibers.

2. The process of claim 1 wherein in step (a) the zein is mixed with water at a temperature of about 0° to about 18° C. to form a free-flowing particulate mixture.

3. The process of claim 1 wherein step (c) occurs at a temperature of about 55° C. to about 63° C.

4. The process of claim 2 wherein steps (b) and (c) comprise extruding the zein hydrate melt through a spinneret using an extruder having a plurality of zones, the initial zones of said extruder having an ambient temperature and the latter zones having a temperature of about 40° C. to about 50° C.

5. The process of claim 1 wherein in step (a) the zein comprises about 50% to about 70% by weight of the zein/water mixture.

6. The process of claim 1 further comprising adding about 10% to about 15% by weight of a plasticizer to the mixture in part (a) .

7. The process of claim 6 wherein the plasticizer is selected from the group consisting of: propylene glycol, and polyethylene glycol having a molecular weight below about 600.

8. The process of claim 1 wherein the stabilizing solution comprises formaldehyde.

9. The process of claim 1 wherein step (e) occurs subsequent to step (d) and the fibers are drawn at a draw ratio greater than about 2.

* * * * *